US012612774B2

(12) United States Patent
Song

(10) Patent No.: US 12,612,774 B2
(45) Date of Patent: Apr. 28, 2026

(54) UV LIGHT SANITIZING SOLUTIONS FOR SANITARY WARES

(71) Applicant: AS America, Inc., Piscataway, NJ (US)

(72) Inventor: Ki Bok Song, Plainview, NY (US)

(73) Assignee: AS America, Inc., Piscataway, NJ (US)

( * ) Notice: Subject to any disclaimer, the term of this patent is extended or adjusted under 35 U.S.C. 154(b) by 120 days.

(21) Appl. No.: 18/450,269

(22) Filed: Aug. 15, 2023

(65) Prior Publication Data

US 2024/0068218 A1 Feb. 29, 2024

Related U.S. Application Data

(60) Provisional application No. 63/401,000, filed on Aug. 25, 2022.

(51) Int. Cl.

| | |
|---|---|
| ***E03D 9/00*** | (2006.01) |
| ***A47K 17/00*** | (2006.01) |
| ***E03D 13/00*** | (2006.01) |

(52) U.S. Cl.
CPC ..... *E03D 9/002* (2013.01); *A47K 17/00* (2013.01); *E03D 13/005* (2013.01)

(58) Field of Classification Search
CPC ..... E03D 5/105; E03D 13/005; E03D 9/002; A47K 17/00; A61L 9/20; A61L 2/10
See application file for complete search history.

(56) References Cited

U.S. PATENT DOCUMENTS

| | | | | |
|---|---|---|---|---|
| 4,167,196 | A * | 9/1979 | Morris | H02G 3/121 220/3.4 |
| 10,207,015 | B2 | 2/2019 | Dayton | |
| 10,857,249 | B2 | 12/2020 | Brais et al. | |
| 10,894,103 | B2 * | 1/2021 | Dobrinsky | A61L 2/10 |
| 10,994,040 | B2 | 5/2021 | Kennedy et al. | |
| 2017/0168508 | A1 * | 6/2017 | Bush | G05D 7/0635 |
| 2018/0347167 | A1 * | 12/2018 | Tsujita | E03D 5/04 |
| 2021/0244837 | A1 * | 8/2021 | Dijkstra | A61L 2/24 |
| 2022/0378966 | A1 * | 12/2022 | Peterson | A61L 2/10 |

FOREIGN PATENT DOCUMENTS

| | | |
|---|---|---|
| GB | 2420062 A | 5/2006 |
| JP | 2007-130029 A | 5/2007 |
| WO | 2022/055889 A1 | 3/2022 |

* cited by examiner

*Primary Examiner* — Janie M Loeppke
(74) *Attorney, Agent, or Firm* — Morrison & Foerster LLP

(57) ABSTRACT

A sanitary ware may include an ultraviolet (UV) light source configured to emit UV light to illuminate a target disinfection volume. The sanitary ware may include a controller comprising one or more processors that is electrically coupled to the UV light source. The one or more processors may be configured to cause the controller to detect that one or more activation conditions have been met and, in response to detecting that the one or more activation conditions have been met, activate the UV light source.

19 Claims, 8 Drawing Sheets

UV LIGHT SANITIZING SOLUTIONS FOR SANITARY WARES

CROSS-REFERENCE TO RELATED APPLICATION

This application claims the benefit of U.S. Provisional Application No. 63/401,000, filed Aug. 25, 2022, the entire contents of which is incorporated herein by reference.

FIELD

The present disclosure relates to sanitizing systems that utilize ultraviolet light to disinfect sanitary wares.

BACKGROUND

Sanitary wares such as toilets, urinals, sinks used at a high rate by large numbers of people require frequent sanitation in order to prevent the accumulation and spread of pathogens. Typically, sanitary wares, as well as fittings such as flush valves and faucets that are associated with sanitary wares, are cleaned manually using chemical disinfectants. Effective manual disinfection of sanitary wares may be time consuming and challenging, particularly in public restrooms used by large volumes of people.

SUMMARY

Due to its high energy, ultraviolet (UV) light may be used to eliminate bacteria, viruses, and fungi known to cause infections and disease in humans. Thus, sanitary wares may be disinfected by illuminating them with UV light. However, exposure to UV light is associated with health issues in humans. Safe and effective UV sanitation systems for sanitary wares must expose the sanitary wares to doses of UV light sufficient to eliminate harmful pathogens while simultaneously ensuring that users are not exposed to harmful levels of UV light.

The present disclosure provides sanitary wares with ultraviolet sanitation systems that automatically illuminate a well-defined target area with UV light after determining that one or more activation conditions have been met. In some embodiments, a bathroom product may comprise a flush valve assembly for a toilet or a urinal that houses a UV light source configured to illuminate at least a portion of the toilet or urinal. In some embodiments, a bathroom product may comprise a faucet assembly that houses a UV light source configured to illuminate at least a portion of a sink. In some embodiments, a bathroom product may comprise a bathroom stall comprising a UV light source that is mounted on a ceiling and is configured to illuminate one or more hardware fixtures contained in the stall.

In some embodiments, the one or more activation conditions may be associated with a presence of a user in a certain proximity of the bathroom product. The UV sanitation systems may include a controller configured to receive information associated with a user presence. For example, in some embodiments, the controller may be configured to receive user presence information from a motion sensor or a presence sensor. Once the controller has determined that the activation conditions have been met, the controller may be configured to activate the UV light source for at least a threshold activation time to ensure that the illuminated bathroom products receive a sufficient dose of ultraviolet light. In some embodiments, after the threshold activation time has passed, the controller may automatically deactivate the UV light source. In some embodiments, if the controller receives information indicating that a user has come within a certain distance of the bathroom product while the UV light source is activated, the controller may be configured to automatically deactivate the UV light source. This may ensure that bathroom product users are not exposed to harmful ultraviolet radiation.

In some embodiments, a flush valve assembly may comprise a flush valve housing, wherein the flush valve housing houses a flush valve that is configured to be fluidically connected to and receive flush water from a water supply, a flush water delivery pipe comprising an inlet end that is fluidically connected to and configured to receive the flush water from the flush valve and comprising an outlet and that is fluidically connected to and configured to deliver the flush water to a sanitary ware, an ultraviolet (UV) light source housed at least partially within the flush valve housing and configured to emit UV light through an aperture formed in the flush valve housing, wherein the emitted UV light illuminates a target disinfection volume, and a controller comprising one or more processors, wherein the controller is electrically coupled to the UV light source, and wherein the one or more processors are configured to cause the controller to: detect that one or more activation conditions have been met; and in response to detecting that the one or more activation conditions have been met, activate the UV light source.

In some embodiments of the flush valve assembly, the sanitary ware is a toilet.

In some embodiments of the flush valve assembly, wherein the target disinfection volume includes a toilet bowl of the toilet, a toilet seat of the toilet, and a portion of a floor below the toilet.

In some embodiments of the flush valve assembly, the sanitary ware is a urinal.

In some embodiments of the flush valve assembly, the target disinfection volume includes a urinal bowl of the urinal, a top surface of a urinal housing of the urinal, and a portion of a floor below the urinal.

In some embodiments of the flush valve assembly, the target disinfection volume comprises a conical volume with an apex at the UV light source.

In some embodiments of the flush valve assembly, an apex angle of the conical volume is greater than or equal to 10 degrees and less than or equal to 60 degrees.

In some embodiments of the flush valve assembly, the UV light source is adjustable between at least a first directional configuration and a second directional configuration, wherein, in the first directional configuration, a center-line of the conical volume is directed in a first direction from the UV light source, and, in the second directional configuration, the center-line of the conical volume is directed in a second direction from the UV light source.

In some embodiments of the flush valve assembly, the UV light source is adjustable between at least a first cone-width configuration and a second cone-width configuration, wherein, in the first cone-width configuration, the conical volume is defined by a first apex angle and, in the second cone-width configuration, the conical volume is defined by a second apex angle.

In some embodiments of the flush valve assembly, the UV light emitted by the UV light source has a wavelength greater than or equal to 200 nanometers and less than or equal to 280 nanometers.

In some embodiments of the flush valve assembly, the UV light source is configured to deliver a dose of the UV light greater than or equal to 5.0 mJ/cm2 throughout the threshold disinfection volume.

In some embodiments of the flush valve assembly, the UV light source comprises one or more LEDs.

In some embodiments of the flush valve assembly, the flush valve assembly comprises a presence sensor, and the one or more activation conditions comprise that a user is detected by the presence sensor within a predetermined proximity of the sanitary ware.

In some embodiments of the flush valve assembly, the flush valve assembly comprises a presence sensor, and detecting that the one or more activation conditions have been met comprises: receiving a first user presence status from the presence sensor indicating that a user is within a predetermined proximity of the sanitary ware; determining that the flush valve has been opened by the valve control; determining that the flush valve has closed; and receiving a second user presence status from the presence sensor indicating that the user is no longer within the predetermined proximity.

In some embodiments of the flush valve assembly, the one or more activation conditions comprise that a room light is off for a room in which the sanitary ware is located.

In some embodiments of the flush valve assembly, the one or more activation conditions comprise that a person is not present within a room in which the sanitary ware is located.

In some embodiments of the flush valve assembly, the one or more activation conditions comprise that one or more predetermined schedule criteria are met.

In some embodiments of the flush valve assembly, after activating the UV light source, the controller is configured to determine that a threshold activation period has passed and, in response to determining that the threshold activation period has passed, deactivate the UV light source.

In some embodiments of the flush valve assembly, the threshold activation period is greater than or equal to 1 minute and less than or equal to 30 minutes.

In some embodiments, a faucet assembly comprises: a faucet body comprising a water outlet and an ultraviolet (UV) light source, wherein the water outlet is configured to dispense water in a first direction with respect to the faucet body, wherein the UV light source is configured to emit UV light in the first direction with respect to the faucet body, wherein the emitted UV light illuminates a target disinfection volume, and a controller comprising one or more processors, wherein the controller is electrically coupled to the UV light source, and wherein the one or more processors are configured to cause the controller to: detect that one or more activation conditions have been met; and in response to detecting that one or more activation conditions have been met activate the UV light source.

In some embodiments of the faucet assembly, the UV light source is adjacent to the water outlet.

In some embodiments of the faucet assembly, the UV light source encircles the water outlet.

In some embodiments of the faucet assembly, the target disinfection volume comprises a conical volume with an apex at the UV light source.

In some embodiments of the faucet assembly, an apex angle of the conical volume is greater than or equal to 10 degrees and less than or equal to 60 degrees.

In some embodiments of the faucet assembly, the UV light source is adjustable between at least a first directional configuration and a second directional configuration, wherein, in the first directional configuration, a center-line of the conical volume is directed in a first direction from the UV light source, and, in the second directional configuration, the center-line of the conical volume is directed in a second direction from the UV light source.

In some embodiments of the faucet assembly, the UV light source is adjustable between at least a first cone-width configuration and a second cone-width configuration, wherein, in the first cone-width configuration, the conical volume is defined by a first apex and, in the second cone-width configuration, the conical volume is defined by a second apex angle.

In some embodiments of the faucet assembly, the UV light emitted by the UV light source has a wavelength greater than or equal to 200 nanometers and less than or equal to 280 nanometers.

In some embodiments of the faucet assembly, the UV light source is configured to deliver a dose of the UV light greater than or equal to 5.0 mJ/cm2 throughout the target disinfection volume.

In some embodiments of the faucet assembly, the UV light source comprises one or more LEDs.

In some embodiments of the faucet assembly, the faucet assembly comprises a presence sensor, and the one or more activation conditions comprise that a user is detected by the presence sensor within a predetermined proximity of the faucet body.

In some embodiments of the faucet assembly, the flush valve assembly comprises a presence sensor, and detecting that the one or more activation conditions have been met comprises: receiving a first user presence status from the presence sensor indicating that a user is within a predetermined proximity of the faucet body; determining that water is being dispensed from the water outlet; after determining that water is being dispensed from the water outlet, determining that water is no longer being dispensed from the water outlet; and receiving a second user presence status from the presence sensor indicating that the user is no longer within the predetermined proximity.

In some embodiments of the faucet assembly, the one or more activation conditions comprise that a room light is off for a room in which the faucet body is located.

In some embodiments of the faucet assembly, the one or more activation conditions comprise that a person is not present within a room in which the faucet body is located.

In some embodiments of the faucet assembly, a spatial position sensor configured to detect a spatial configuration of the faucet body, wherein the one or more activation conditions comprise that the faucet body is determined to be in a predetermined spatial configuration by the spatial position sensor.

In some embodiments of the faucet assembly, the one or more activation conditions comprise that one or more predetermined schedule criteria are met.

In some embodiments of the faucet assembly, after activating the UV light source, the controller is configured to determine that a threshold activation period has passed and, in response to determining that the threshold activation period has passed, deactivate the UV light source.

In some embodiments of the faucet assembly, the threshold activation period is greater than or equal to 1 minute and less than or equal to 30 minutes.

In some embodiments of the faucet assembly, the one or more activation conditions comprise that signals are received from at least two separate sensors, wherein each signal provides information associated with a user presence in a room where the sanitary ware is located.

In some embodiments of the faucet assembly, the one or more activation conditions comprise that signals are received from at least two separate sensors, wherein each signal provides information associated with a user presence in a room where the faucet body is located.

BRIEF DESCRIPTION OF THE FIGURES

The following figures show various exemplary bathroom product assemblies with ultraviolet sanitizing systems and exemplary methods for controlling said ultraviolet sanitizing systems, in accordance with some embodiments. The bathroom product assemblies and ultraviolet sanitation systems may, in some embodiments, have any one or more of the characteristics described herein.

DETAILED DESCRIPTION

Figure 1C:
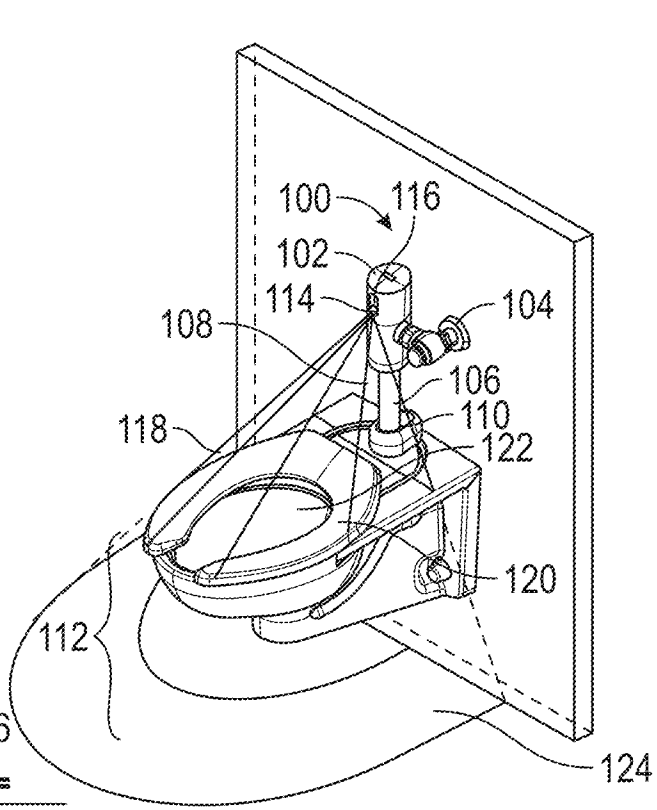
FIG. 1C illustrates a perspective view of an exemplary flush valve assembly with an ultraviolet light module for sanitizing a toilet, according to some embodiments.

Ultraviolet (UV) light is a form of electromagnetic radiation with wavelength between 10 nanometers and 400 nanometers. UV light carries more energy than light with longer wavelengths (e.g., visible light). As a result, exposure to sufficiently high doses of ultraviolet light may damage the DNA or RNA of harmful pathogens such as bacteria, preventing them from reproducing. Thus, UV light may be an effective sterilization tool. However, the energy carried by the UV light may also cause damage to the skin or the eyes of humans who are exposed.

Provided herein are sanitary wares (e.g., faucet assemblies and flush valve assemblies) with ultraviolet sanitation systems that automatically illuminate a well-defined target area with UV light after determining that one or more activation conditions have been met. In some embodiments, the one or more activation conditions may be associated with a presence of a user in a certain proximity of the bathroom product. The UV sanitation systems may include a controller configured to receive information associated with a user presence. Once the controller has determined that the activation conditions have been met, the controller may be configured to activate the UV light source for at least a threshold activation time to ensure that the illuminated bathroom products receive a sufficient dose of ultraviolet light. In some embodiments, after the threshold activation time has passed, the controller may automatically deactivate the UV light source. In some embodiments, if the controller receives information indicating that a user has come within a certain distance of the sanitary ware while the UV light source is activated, the controller may be configured to automatically deactivate the UV light source. This may ensure that sanitary ware users are not exposed to harmful ultraviolet radiation.

Definitions

"Sanitary ware," as used herein, refers to bathroom hardware such as toilets, urinals, faucets, and sinks.

"Dose," as used herein, refers to an amount of light to which an illuminated target is exposed. Dose is the amount of energy per unit area delivered to the target or, equivalently, the intensity of light delivered during the time that the target is illuminated.

The "apex angle" of a conical volume refers to the angle at the tip of the conical volume that defines the cone's apex. In other words, the apex angle is the angle that is opposite to the base of the cone.

The "center line" of a conical volume refers to the straight line between the apex of the conical volume and the center of the base of the conical volume.

The "center angle" of a conical volume refers to the angle between the center line of the conical volume and a line parallel to the base of the conical volume.

UV Sanitizing Solutions for Flush Valve Assemblies

Sanitary wares such as toilets and urinals are used to dispose of human waste and therefore are highly likely to host and transmit pathogens. Sanitary wares may have irregular shapes that are difficult to clean manually using chemical disinfectants. A sanitary ware, however, frequently includes a flush valve assembly that is positioned above the sanitary ware. Thus, a flush valve assembly may provide an ideal vantage point for an ultraviolet light source to illuminate and sanitize a sanitary ware. Described below are exemplary flush valve assemblies comprising UV sanitizing systems for sanitizing toilets and urinals.

Figure 1B:
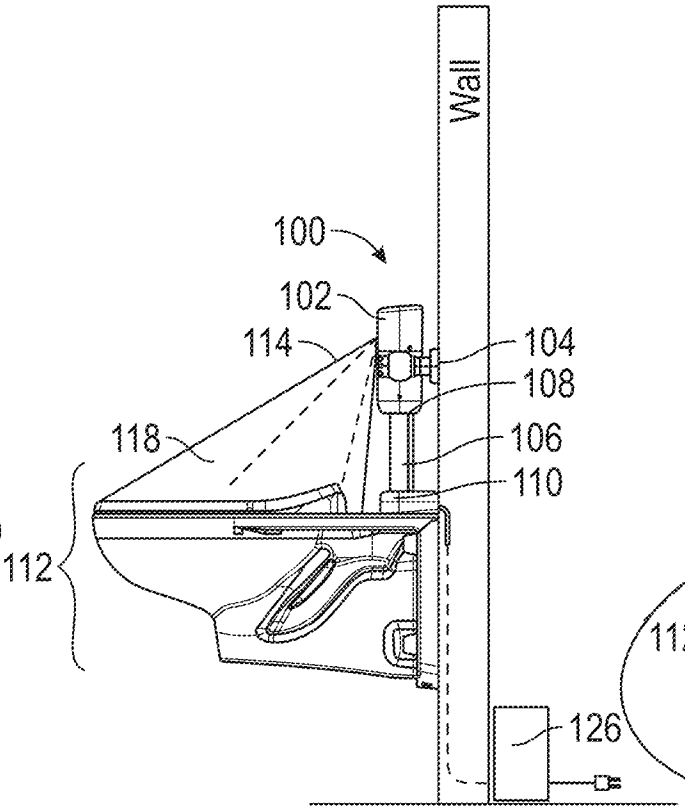
FIG. 1B illustrates a perspective view of an exemplary flush valve assembly with an ultraviolet light module for sanitizing a toilet, according to some embodiments.
Figure 1A:
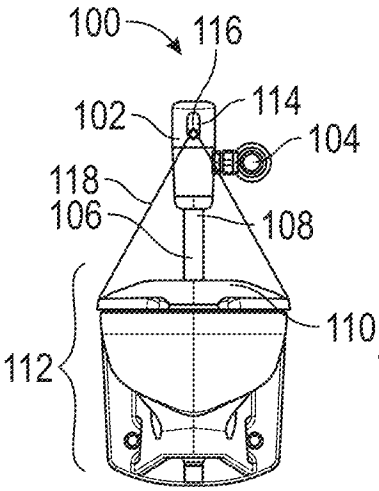
FIG. 1A illustrates a perspective view of an exemplary flush valve assembly with an ultraviolet light module for sanitizing a toilet, according to some embodiments.

FIGS. 1A-1C illustrate perspective views of an exemplary flush valve assembly with an ultraviolet light module for sanitizing a toilet, according to some embodiments. Specifically, FIGS. 1A-1C respectively show a front view, a side view, and a top view of a flush valve assembly 100 comprising an ultraviolet (UV) light source 114 for sanitizing a toilet 112.

Flush valve assembly 100 may comprise a flush valve housing 102. In some embodiments, flush valve housing 102 may comprise stainless steel. In some embodiments, flush valve housing 102 may comprise one or more plastics. In some embodiments, flush valve housing 102 may be configured to be at least partially concealed by a wall behind toilet 112.

Flush valve housing 102 may house a flush valve. The flush valve may be fluidically connected to a flush water inlet 104 which, in turn, may be configured to fluidically couple to a flush water supply. When toilet 112 is flushed, the flush valve housed by flush valve housing 102 may be configured to receive water from the water supply through flush water inlet 104. The flush valve may be fluidically coupled to an inlet end 108 of a flush water delivery pipe 106. In some embodiments, when toilet 112 is flushed, the flush valve may be configured to deliver water received from the water supply to flush water delivery pipe 106. Flush water delivery pipe 106 may transmit the received water to toilet 112 through an outlet end 110 that is fluidically coupled to toilet 112.

In some embodiments, flush water delivery pipe 106 may comprise stainless steel. In some embodiments, flush water delivery pipe 106 may comprise one or more plastics. In some embodiments, flush water delivery pipe 106 may be greater than or equal to 0.5, 1, 1.5, 2, 2.5, or 3 feet in length. In some embodiments, flush water delivery pipe 106 may be less than or equal to 0.5, 1, 1.5, 2, 2.5, or 3 feet in length. In some embodiments, flush water delivery pipe 106 may be between about 1-2, about 2-3, or about 3-4 feet in length. In some embodiments, flush water delivery pipe 106 may be configured to be concealed within a wall behind toilet 112.

In some embodiments, the flush valve housed by flush valve housing 102 may be a manual flush valve configured to be manually controlled by a user (e.g., with a lever or a button). In some embodiments, the flush valve housed by flush valve housing 102 may be an automatic flush valve configured to automatically flush toilet 112 when one or more conditions are met. For example, the flush valve housed by flush valve housing 102 may be an automatic flush valve that is configured to communicate with a motion sensor or a presence sensor. When the motion sensor detects movement proximal to toilet 112, or when the presence sensor detects a change in user presence proximal to toilet 112, the flush valve housed by flush valve housing 102 may be configured to flush toilet 112.

UV light source 114 may be at least partially housed within flush valve housing 102. Flush valve housing 102 may comprise an aperture 116 through which UV light source 114 is configured to emit ultraviolet light. In some embodiments, UV light source 114 may comprise one or more light-emitting diodes (LEDs).

In some embodiments, the light emitted by UV light source 114 through aperture 116 may be configured to illuminate a target disinfection volume 118. In some embodiments, target disinfection volume 118 may include a toilet seat 120 of toilet 112. In some embodiments, target disinfection volume 118 may include a toilet bowl 122 of toilet 112. In some embodiments, target disinfection volume 118 may include a portion of a floor 124 below toilet 112.

In some embodiments, target disinfection volume 118 may be a conical volume. In some embodiments, target disinfection volume 118 may be a pyramidal volume. In some embodiments, target disinfection volume 118 may encompass a total volume of at least 1, at least 2, at least 3, at least 4, or at least 5 cubic feet. In some embodiments, target disinfection volume 118 may encompass a total volume of less than or equal to 1, 2, 3, 4, or 5 cubic feet.

UV light source 114 may be configured to emit light in the UV-C range (i.e., germicidal ultraviolet light). In some embodiments, UV light source 114 may be configured to emit light with a wavelength less than or equal to 300, 280, 260, 240, 220, 200, or 180 nanometers. In some embodiments, UV light source 114 may be configured to emit light with a wavelength greater than or equal to 300, 280, 260, 240, 220, 200, or 180 nanometers. In some embodiments, UV light source 114 may be configured to emit light with a wavelength between about 200-220, 200-240, 200-260, 200-280, or 200-300 nanometers.

In some embodiments, when activated (i.e., turned on), UV light source 114 may be configured to deliver a specific dose of ultraviolet light to target disinfection volume 118. In some embodiments, UV light source 114 may be configured to deliver at least 1, at least 5, at least 10, at least 20, at least 30, at least 40, at least 50, at least 60, at least 70, at least 80, at least 90, or at least 100 $mJ/cm^2$ of ultraviolet light to target disinfection volume 118. In some embodiments, UV light source 114 may be configured to deliver less than or equal to 1, 5, 10, 20, 30, 40, 50, 60, 70, 80, 90, or 100 $mJ/cm^2$ of ultraviolet light to target disinfection volume 118. The dose of ultraviolet light delivered by UV light source 114 may be configured to target and eliminate one or more bacteria, fungi, or viruses. For example, in some embodiments, UV light source 114 may be configured to target and eliminate *Streptococcus* bacteria and thus may deliver a dose of UV light between about 2 $mJ/cm^2$ and about 12 $mJ/cm^2$ to target disinfection volume 118. In some embodiments, UV light source 114 may be configured to target and eliminate *E. coli* bacteria and thus may deliver a dose of UV light between about 1.5 $mJ/cm^2$ and about 17 $mJ/cm^2$ to target disinfection volume 118.

In some embodiments, UV light source 114 may receive energy from a power source 126. In some embodiments, UV light source 114 may be electrically coupled to power source 126 through a wired connection. In some embodiments, UV light source 114 may receive power wirelessly from power source 126. In some embodiments, power source 126 may include one or more batteries. In some embodiments, power source 126 may be configured to electrically couple to a power supply for a building (e.g., a power supply for an office).

In some embodiments, UV light source 114 may be controlled by a controller comprising one or more processors. The controller may be housed by flush valve housing 102. In some embodiments, the controller may be configured to detect that one or more activation conditions have been met and, in response to detecting that the one or more activation conditions have been met, activate UV light source 114. In some embodiments, the activation conditions may be associated with a user presence in a predetermined proximity of toilet 112.

Figure 2C:
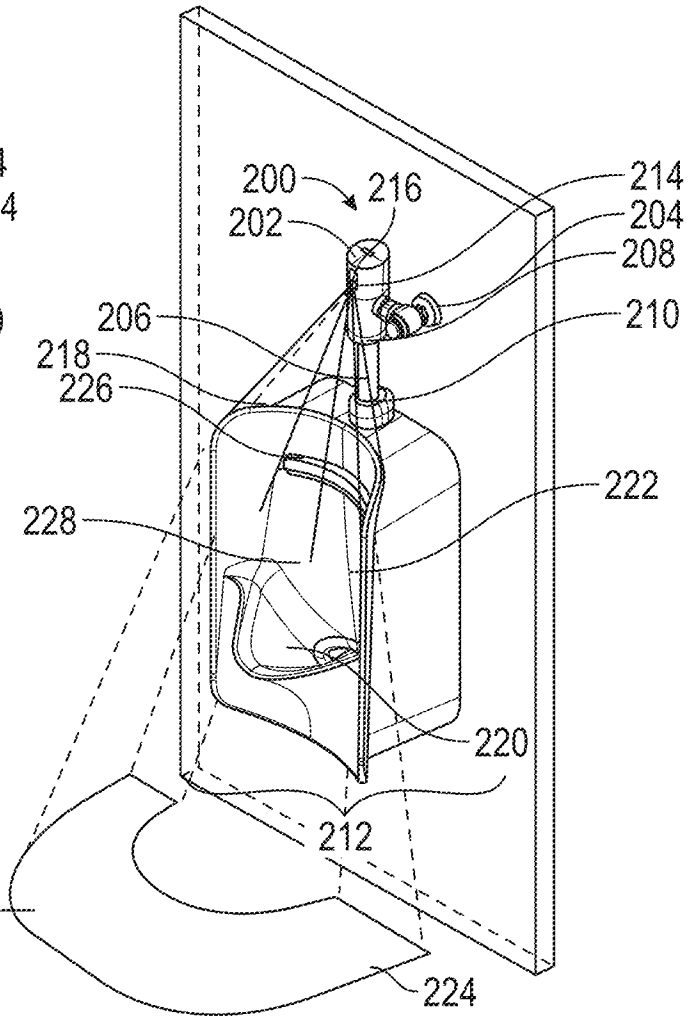
FIG. 2C illustrates a perspective view of an exemplary flush valve assembly with an ultraviolet light module for sanitizing a toilet, according to some embodiments.
Figure 2B:
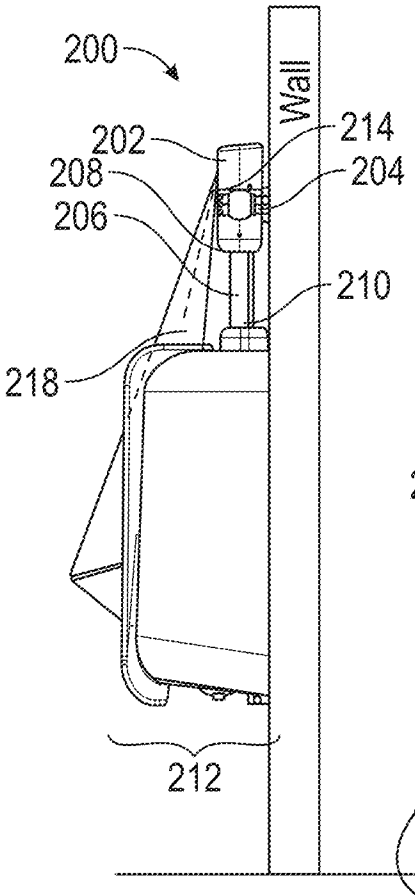
FIG. 2B illustrates a perspective view of an exemplary flush valve assembly with an ultraviolet light module for sanitizing a urinal, according to some embodiments.
Figure 2A:
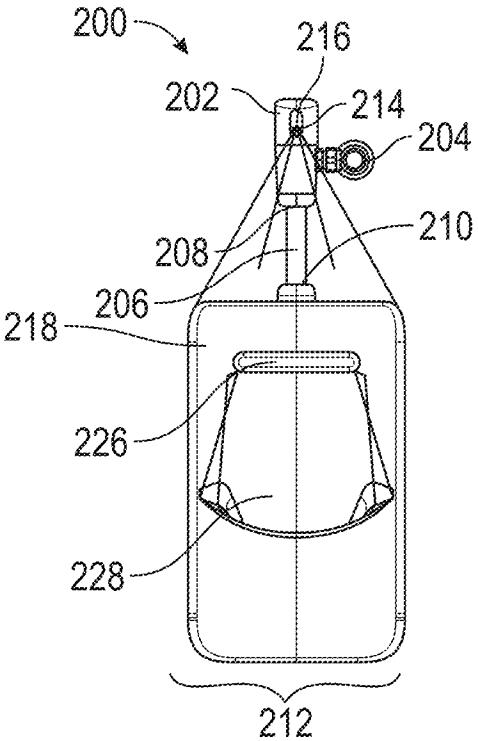
FIG. 2A illustrates a perspective view of an exemplary flush valve assembly with an ultraviolet light module for sanitizing a urinal, according to some embodiments.

FIGS. 2A-2C illustrate perspective views of an exemplary flush valve assembly with an ultraviolet light module for sanitizing a urinal, according to some embodiments. Specifically, FIGS. 2A-2C respectively show a front view, a side view, and a top view of a flush valve assembly 200 comprising an ultraviolet light source 214 for sanitizing a urinal 212.

Flush valve assembly 200 may comprise a flush valve housing 202. In some embodiments, flush valve housing 202 may comprise stainless steel. In some embodiments, flush valve housing 202 may comprise one or more plastics. In some embodiments, flush valve housing 202 may be configured to be at least partially concealed by a wall behind urinal 212.

Flush valve housing 202 may house a flush valve. The flush valve may be fluidically connected to a flush water inlet 204 which, in turn, may be configured to fluidically couple to a flush water supply. When urinal 212 is flushed, the flush valve housed by flush valve housing 202 may be configured to receive water from the water supply through flush water inlet 204. The flush valve may be fluidically coupled to an inlet end 208 of a flush water delivery pipe 206. In some embodiments, when urinal 212 is flushed, the flush valve may be configured to deliver water received from the water supply to flush water delivery pipe 206. Flush water delivery pipe 206 may transmit the received water to urinal 212 through an outlet end 210 that is fluidically coupled to urinal 212.

In some embodiments, flush water delivery pipe 206 may comprise stainless steel. In some embodiments, flush water delivery pipe 206 may comprise one or more plastics. In some embodiments, flush water delivery pipe 206 may be greater than or equal to 0.5, 1, 1.5, 2, 2.5, or 3 feet in length. In some embodiments, flush water delivery pipe 206 may be less than or equal to 0.5, 1, 1.5, 2, 2.5, or 3 feet in length. In some embodiments, flush water delivery pipe 206 may be between about 1-2, about 2-3, or about 3-4 feet in length. In some embodiments, flush water delivery pipe 206 may be configured to be concealed within a wall behind urinal 212.

In some embodiments, the flush valve housed by flush valve housing 202 may be a manual flush valve configured to be manually controlled by a user (e.g., with a lever or a button). In some embodiments, the flush valve housed by flush valve housing 202 may be an automatic flush valve configured to automatically flush urinal 212 when one or more conditions are met. For example, the flush valve housed by flush valve housing 202 may be an automatic flush valve that is configured to communicate with a motion sensor or a presence sensor. When the motion sensor detects movement proximal to urinal 212, or when the presence sensor detects a change in user presence proximal to urinal 212, the flush valve housed by flush valve housing 202 may be configured to flush urinal 212.

UV light source 214 may be at least partially housed within flush valve housing 202. Flush valve housing 202 may comprise an aperture 216 through which UV light source 214 is configured to emit ultraviolet light. In some embodiments, UV light source 214 may comprise one or more light-emitting diodes (LEDs).

In some embodiments, the light emitted by UV light source 214 through aperture 216 may be configured to illuminate a target disinfection volume 218. In some embodiments, target disinfection volume 218 may include a urinal bowl (i.e., urinal basin) 220 of urinal 212. In some embodiments, target disinfection volume 218 may include a urinal wall 222 of urinal 212. Urinal wall 222 may be configured to receive flush water when urinal 212 is flushed. In some embodiments, target disinfection volume 218 may include a portion of a floor 224 below urinal 212.

In some embodiments, target disinfection volume 218 may be a conical volume. In some embodiments, target disinfection volume 218 may be a pyramidal volume. In some embodiments, target disinfection volume 218 may encompass a total volume of at least 1, at least 2, at least 3, at least 4, or at least 5 cubic feet. In some embodiments, target disinfection volume 218 may encompass a total volume of less than or equal to 1, 2, 3, 4, or 5 cubic feet.

UV light source 214 may be configured to emit light in the UV-C range (i.e., may be configured to emit "germicidal" ultraviolet light). In some embodiments, UV light source 214 may be configured to emit light with a wavelength less than or equal to 300, 280, 260, 240, 220, 200, or 180 nanometers. In some embodiments, UV light source 214 may be configured to emit light with a wavelength greater than or equal to 300, 280, 260, 240, 220, 200, or 180 nanometers. In some embodiments, UV light source 214 may be configured to emit light with a wavelength between about 200-220, 200-240, 200-260, 200-280, or 200-300 nanometers.

In some embodiments, when activated (i.e., turned on), UV light source 214 may be configured to deliver a specific dose of ultraviolet light to target disinfection volume 218. In some embodiments, UV light source 214 may be configured to deliver at least 1, at least 5, at least 10, at least 20, at least 30, at least 40, at least 50, at least 60, at least 70, at least 80, at least 90, or at least 100 $mJ/cm^2$ of ultraviolet light to target disinfection volume 218. In some embodiments, UV light source 214 may be configured to deliver less than or equal to 1, 5, 10, 20, 30, 40, 50, 60, 70, 80, 90, or 100 $mJ/cm^2$ of ultraviolet light to target disinfection volume 218. The dose of ultraviolet light delivered by UV light source 214 may be configured to target and eliminate one or more bacteria, fungi, or viruses. For example, in some embodiments, UV light source 214 may be configured to target and eliminate *Streptococcus* bacteria and thus may deliver a dose of UV light between about 2 $mJ/cm^2$ and about 12 $mJ/cm^2$ to target disinfection volume 218. In some embodiments, UV light source 214 may be configured to target and eliminate *E. coli* bacteria and thus may deliver a dose of UV light between about 1.5 $mJ/cm^2$ and about 17 $mJ/cm^2$ to target disinfection volume 218.

In some embodiments, UV light source 214 may receive energy from a power source. In some embodiments, UV light source 114 may be electrically coupled to the power source through a wired connection. In some embodiments, UV light source 114 may receive power wirelessly from the power source. In some embodiments, the power source may include one or more batteries.

In some embodiments, UV light source 214 may be controlled by a controller comprising one or more processors. The controller may be housed by flush valve housing 202. In some embodiments, the controller may be configured to detect that one or more activation conditions have been met and, in response to detecting that the one or more activation conditions have been met, activate UV light source 214. In some embodiments, the activation conditions may be associated with a user presence in a predetermined proximity of urinal 212.

In some embodiments, urinal 212 may comprise a UV light source 226 that is at least partially housed in urinal wall 222. In some embodiments, UV light source 226 may be disposed adjacent to or along a flush bar configured to transmit flush water into urinal 212. UV light source 226 may be configured to emit ultraviolet light through an aperture formed in urinal wall 222. In some embodiments, the aperture may be an approximately rectangular opening in the surface of urinal wall 222. In some embodiments, the aperture may be greater than or equal to 2, 3, 4, 5, or 10 inches in length. In some embodiments, the aperture may be less than or equal to 2, 3, 4, 5, or 10 inches in length. The ultraviolet light emitted by UV light source 226 may illuminate a target disinfection volume 228. In some embodiments, target disinfection volume 228 may include urinal bowl 120 and one or more surfaces of urinal wall 222. In some embodiments, UV light source 226 may be provided in addition to UV light source 214 in order to increase a total dose of ultraviolet light that is delivered to a specific portion of urinal 212.

Figure 3C:
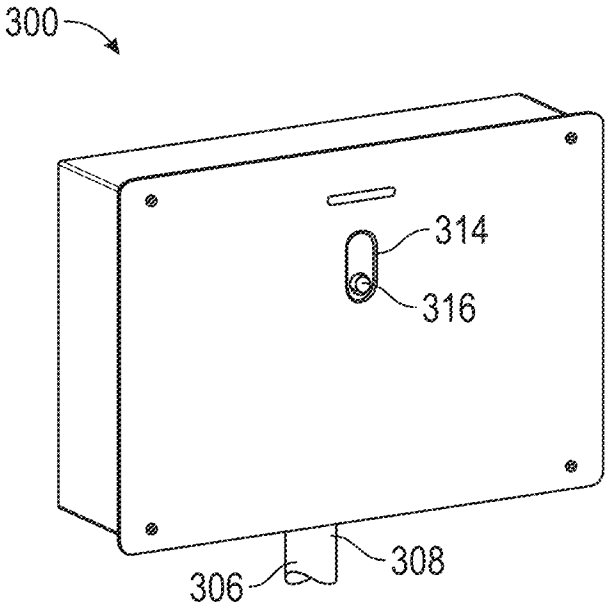
FIG. 3C illustrates a close-up view of an exemplary concealed flush valve assembly with an ultraviolet light module for sanitizing a sanitary ware, according to some embodiments.
Figure 3B:
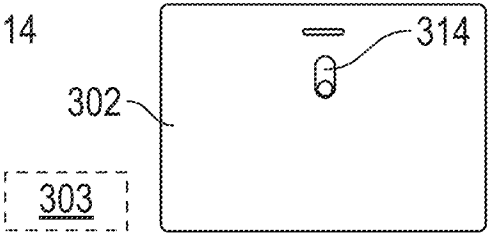
FIG. 3B illustrates a perspective view of an exemplary concealed flush valve assembly with an ultraviolet light module for sanitizing a toilet, according to some embodiments.
Figure 3B:
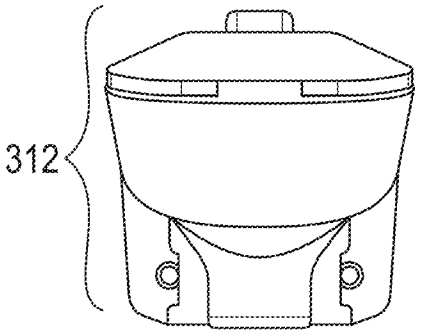
Figure 3A:
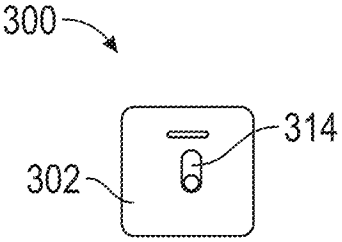
FIG. 3A illustrates a perspective view of an exemplary concealed flush valve assembly with an ultraviolet light module for sanitizing a toilet, according to some embodiments.
Figure 3A:
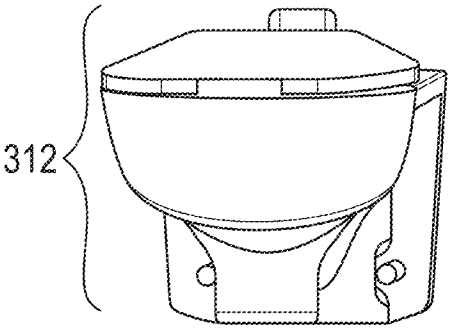

FIGS. 3A-3B illustrate perspective views of an exemplary concealed flush valve assembly with an ultraviolet light module for sanitizing a sanitary ware, according to some embodiments. Specifically, FIGS. 3A-3B show front views of a concealed flush valve assembly 300 comprising a UV light source 314 for sanitizing a sanitary ware 312. As shown, in some embodiments, sanitary ware 312 may be a toilet (e.g., toilet 112 shown in FIGS. 1A-1C). In some embodiments, sanitary ware 312 may be a urinal (e.g., urinal 312 shown in FIGS. 2A-2C). A close-up view of concealed flush valve assembly 300 is shown in FIG. 3C. In some embodiments, flush valve assembly 100 shown in FIG. 1 may include one or more features of concealed flush valve assembly 300. In some embodiments, flush valve assembly 200 shown in FIG. 2 may include one or more features of concealed flush valve assembly 300.

Concealed flush valve assembly 300 may comprise a flush valve housing 302 that may be at least partially housed within a wall 303 behind sanitary ware 312. Flush valve housing 302 may house a flush valve. The flush valve may be configured to fluidically connect to a flush water supply. When sanitary ware 312 is flushed, the flush valve housed by flush valve housing 302 may be configured to receive water from the water supply. The flush valve may be fluidically coupled to an inlet end 308 of flush water delivery pipe 306. Flush water delivery pipe 306 may be concealed by wall 303. In some embodiments, when sanitary ware 312 is flushed, the flush valve may be configured to deliver water received from the water supply to flush water delivery pipe 306. Flush water delivery pipe 306 may transmit the received water to sanitary ware 312 through an outlet end that is fluidically coupled to sanitary ware 312.

UV light source 314 may be at least partially housed in flush valve housing 302. In some embodiments, UV light source 314 may be configured to emit ultraviolet light through an aperture 316 in flush valve housing 302. In some embodiments, the UV light emitted by UV light source 314 may be configured to illuminate a target disinfection volume (e.g., target disinfection volume 118 shown in FIGS. 1A-1C or target disinfection volume 218 shown in FIGS. 2A-2C).

UV Sanitizing Solutions for Faucet Assemblies

Bathroom sink assemblies, like sanitary wares such as toilets and urinals, are highly likely to harbor harmful pathogens. Fittings such as faucet assemblies that are associated with sink assemblies come into frequent contact with large numbers of people, especially if a sink assembly is in a public space. In some situations, the moist environment of a sink or a drain associated with a faucet assembly may provide ideal conditions for bacterial or fungal growth. As described below, housing an ultraviolet sanitizing systems housed in a faucet body may allow the sink, drain, and/or countertop associated with a faucet assembly to be effectively sanitized using UV radiation.

Figure 4B:
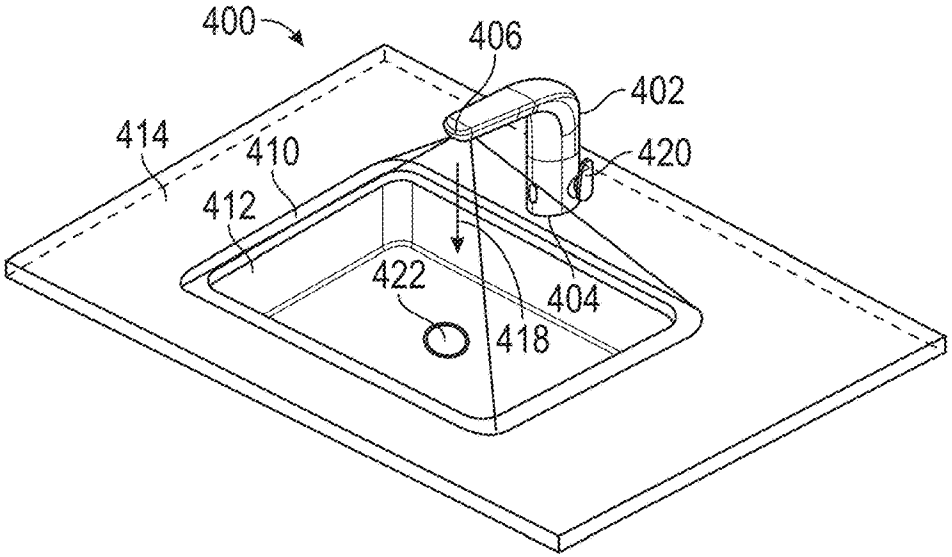
FIG. 4B illustrates a perspective view of an exemplary faucet assembly with an ultraviolet light module, according to some embodiments.
Figure 4C:
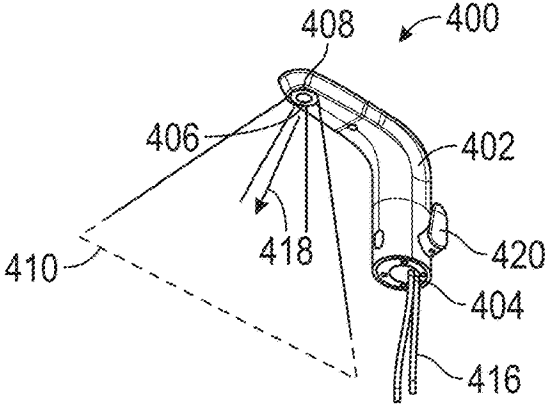
FIG. 4C illustrates a perspective view of an exemplary faucet assembly with an ultraviolet light module, according to some embodiments.
Figure 4A:
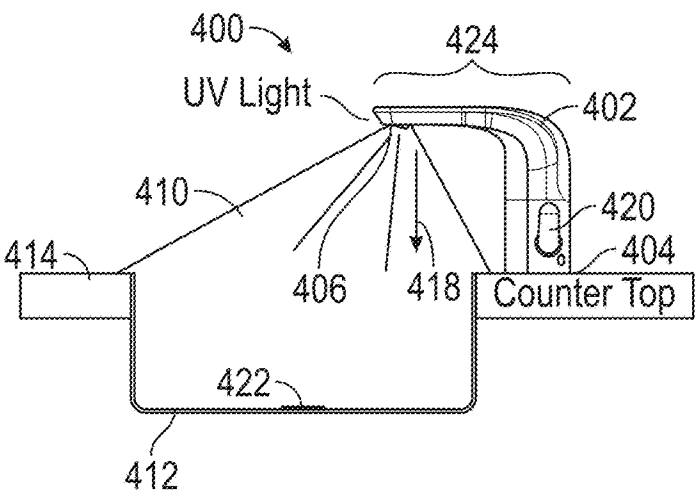
FIG. 4A illustrates a perspective view of an exemplary faucet assembly with an ultraviolet light module, according to some embodiments.

FIGS. 4A-4C illustrate perspective views of an exemplary faucet assembly with an ultraviolet light module, according to some embodiments. Specifically, FIGS. 4A-4C respectively show a front view, a side view, and a bottom view of a faucet assembly 400 comprising an ultraviolet (UV) light source 408.

As shown, faucet assembly 400 may comprise a faucet body 402. Faucet body 402 may be mounted on a countertop 414 and may be configured to deliver water to a sink 412. In some embodiments, faucet body 402 may comprise stainless steel. In some embodiments, faucet body 402 may comprise one or more plastics.

Faucet body 402 may comprise a water inlet 404 and a water outlet 406. Faucet body 402 may house a water flow path configured to fluidically couple water inlet 404 to water outlet 406. Water inlet 404 may be configured to fluidically couple to a water supply. In some embodiments, water inlet 404 may be configured to fluidically couple to a water supply via a mixing valve. Water flow into water inlet 404, through faucet body 402, and out of water outlet 406 may be controlled by a faucet control 420. In some embodiments, faucet control 420 may comprise one or more buttons, one or more knobs, a motion sensor, or a presence sensor.

In some embodiments, a portion of faucet body 402 that includes water outlet 406 may be configured to pull away from faucet body 402 (i.e., faucet assembly 400 may be a pull-out faucet). In some embodiments, the position of faucet body 402 relative to sink 412 may be adjustable.

In some embodiments, UV light source 408 may be adjacent to water outlet 406. In some embodiments, UV light source 408 may encircle water outlet 406. UV light source 408 may comprise one or more light-emitting diodes (LEDs). In some embodiments, UV light source 408 may be configured to emit ultraviolet light in a target direction 418 with respect to faucet body 402. In some embodiments, target direction 418 may be perpendicular to an upper portion 424 of faucet body 402. In some embodiments, target direction 418 may be parallel to a direction of water flow through water outlet 406.

UV light source 408 may be configured to emit ultraviolet light to illuminate a target disinfection volume 410. In some embodiments, target disinfection volume 410 may include at least a portion of sink 412. In some embodiments, target disinfection volume 410 may include a portion of countertop 414. In some embodiments, target disinfection volume may include a sink drain 422 of sink 412. In some embodiments, target direction 418 may be the direction of a center line through target disinfection volume 410.

In some embodiments, target disinfection volume 410 may be a conical volume. In some embodiments, target disinfection volume 410 may be a pyramidal volume. In some embodiments, target disinfection volume 410 may encompass a total volume of at least 0.25, at least 0.5, at least 0.75, at least 1, or at least 2 cubic feet. In some embodiments, target disinfection volume 218 may encompass a total volume of less than or equal to 0.25, 0.5, 0.75, 1, or 2 cubic feet.

UV light source 408 may be configured to emit light in the UV-C range (i.e., may be configured to emit "germicidal" ultraviolet light). In some embodiments, UV light source 408 may be configured to emit light with a wavelength less than or equal to 300, 280, 260, 240, 220, 200, or 180 nanometers. In some embodiments, UV light source 408 may be configured to emit light with a wavelength greater than or equal to 300, 280, 260, 240, 220, 200, or 180 nanometers. In some embodiments, UV light source 408 may be configured to emit light with a wavelength between about 200-220, 200-240, 200-260, 200-280, or 200-300 nanometers.

In some embodiments, when activated (i.e., turned on), UV light source 408 may be configured to deliver a specific dose of ultraviolet light to target disinfection volume 410. In some embodiments, UV light source 408 may be configured to deliver at least 1, at least 5, at least 10, at least 20, at least 30, at least 40, at least 50, at least 60, at least 70, at least 80, at least 90, or at least 100 $mJ/cm^2$ of ultraviolet light to target disinfection volume 410. In some embodiments, UV light source 408 may be configured to deliver less than or equal to 1, 5, 10, 20, 30, 40, 50, 60, 70, 80, 90, or 100 mJ/cm$^2$ of ultraviolet light to target disinfection volume 410. The dose of ultraviolet light delivered by UV light source 408 may be configured to target and eliminate one or more bacteria, fungi, or viruses. For example, in some embodiments, UV light source 408 may be configured to target and eliminate *Streptococcus* bacteria and thus may deliver a dose of UV light between about 2 mJ/cm$^2$ and about 12 mJ/cm$^2$ to target disinfection volume 410.

In some embodiments, UV light source 408 may receive energy from a power source. In some embodiments, UV light source 408 may be electrically coupled to the power source through one or more wires 416. In some embodiments, UV light source 408 may receive power wirelessly from the power source. In some embodiments, the power source may include one or more batteries.

In some embodiments, UV light source 408 may be controlled by a controller comprising one or more processors. In some embodiments, the controller may be housed by faucet body 402. In some embodiments, the controller may be housed beneath countertop 414. In some embodiments, the controller may be configured to detect that one or more activation conditions have been met and, in response to detecting that the one or more activation conditions have been met, activate UV light source 408.

In some embodiments, the activation conditions may be associated with a user presence in a predetermined proximity of faucet assembly 400. In some embodiments, the activation conditions may be associated with a spatial configuration of faucet body 402. For example, if a spatial position of faucet body 402 is configured to be adjustable (e.g., if faucet body 402 can be twisted to the left and/or to the right by a user), the controller may be configured to activate UV light source 408 only if faucet body 402 is centered over sink 412. In some embodiments, faucet body 402 may be centered over sink 412 when water outlet 406 is positioned directly above sink drain 422. In some embodiments, if faucet body 402 comprises an portion that is fixed to countertop 414 and an extendable spout portion that is configured to pull away from the fixed portion (e.g., if faucet body 402 is a pull-out faucet wherein a portion comprising water outlet 406 can be pulled out by a user) the controller may be configured to activate UV light source 408 only if the extendable spout portion of faucet body 402 is in its retracted position.

UV Sanitizing Systems

Figure 5:
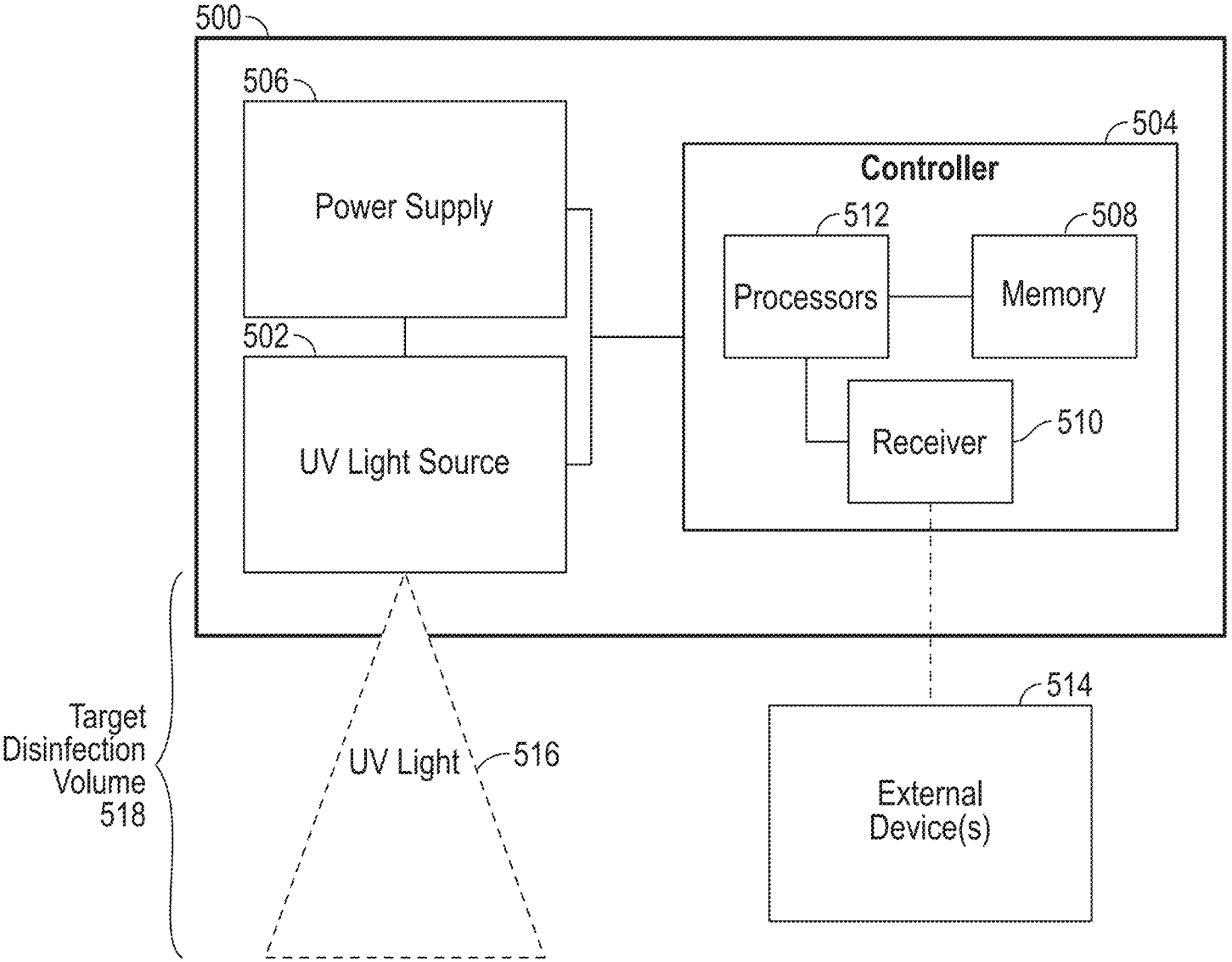
FIG. 5 illustrates a diagram of an exemplary ultraviolet sanitizing system, according to some embodiments.

As previously discussed, an ultraviolet sanitizing system for a sanitary ware such as a faucet assembly or a flush valve assembly may comprise a controller that is configured to automatically activate or deactivate a UV light source based on one or more activation conditions. FIG. 5 illustrates a diagram of an exemplary ultraviolet sanitizing system, according to some embodiments. Specifically, FIG. 5 shows a diagram of an ultraviolet (UV) sanitizing system 500. In some embodiments, UV sanitizing system 500 may be a component of a flush valve assembly for a sanitary ware (e.g., flush valve assembly 100 shown in FIGS. 1A-1C or flush valve assembly 200 shown in FIGS. 2A-2C). In some embodiments, UV sanitizing system 500 may be a component of a faucet assembly (e.g., faucet assembly 400 shown in FIGS. 4A-4C).

UV sanitizing system 500 may comprise a UV light source 502, a controller 504, and a power supply 506. Power supply 506 may be electrically coupled and configured to provide energy to UV light source 502 and controller 506. Controller 506 may comprise one or more processors 512 configured to control UV light source 502. Specifically, in some embodiments, processors 512 may be configured to cause controller 506 to detect that one or more activation conditions have been met and, in response to detecting that the one or more activation conditions have been met, activate UV light source 502. When UV light source 502 is activated by controller 506, UV light source 502 may emit ultraviolet light 516 that illuminates a target disinfection volume 518.

In some embodiments, the one or more activation conditions may be associated with a human presence within a certain proximity of the flush valve assembly or faucet assembly of which UV sanitizing system 500 is a component. In some embodiments, controller 506 may comprise a receiver 510 configured to communicate with one or more external devices 514. External devices 514 may be devices that are separate from UV sanitizing system 500. In some embodiments, external devices 514 may be separate from the flush valve assembly or faucet assembly of which UV sanitizing system is a component. In some embodiments, external devices 514 may comprise one or more "smart" devices configured to connect to and communicate over a wireless network.

In some embodiments, external devices 514 may comprise a presence sensor, and the one or more activation conditions may comprise that a user is detected by the presence sensor. In some embodiments, the presence sensor may be an optical presence sensor (e.g., an infrared presence sensor), an inductive presence sensor, a capacitive presence sensor, or an ultrasonic presence sensor. The presence sensor may be configured to wirelessly communicate with receiver 510 of controller 506 (e.g, using Wi-Fi or Bluetooth). In some embodiments, processors 512 may be configured to cause controller to activate UV light source 502 only when receiver 510 receives information from the presence sensor indicating that the user is not within a predetermined proximity of UV light source 502. In some embodiments, the predetermined proximity may be less than or equal to 5, 4, 3, 2, or 1 feet from UV light source 502. In some embodiments, the predetermined proximity may be any spatial position inside target disinfection volume 518. This may prevent user exposure to ultraviolet radiation from UV light source 502.

In some embodiments, external devices 514 may comprise a presence sensor as described above, and the one or more activation conditions may comprise that a user has recently utilized the sanitary ware of which UV sanitizing system 500 is a component (i.e., has recently utilized the sanitary ware associated with the flush valve assembly or has recently utilized the faucet assembly). In some embodiments, processors 512 may be configured to detect a current configuration of a valve (i.e., detect whether a valve is in an open configuration or a closed configuration). When a user approaches the sanitary ware, a presence sensor may transmit a signal to receiver 510 indicating that the user is within a predetermined proximity of the flush valve assembly or faucet assembly. In some embodiments, after receiver 510 receives the signal indicating that the user is within the predetermined proximity of the flush valve assembly or faucet assembly, processors 512 may detect that a valve (e.g., a flush valve of flush valve assembly 100 shown in FIGS. 1A-1C or a valve associated with faucet assembly 400 shown in FIGS. 4A-4C) has been opened. In some embodiments, after detecting that a valve has been opened, processors 512 may detect that the valve has returned to a closed configuration. Receiver 510 may subsequently receive a signal from the presence sensor indicating that the user is no longer within the predetermined proximity of the sanitary ware.

In some embodiments, the one or more activation conditions may comprise that a room light in a room where the sanitary ware is located is turned off. When the room light is turned off, a human is unlikely to be in the room where the sanitary ware is located, and thus is unlikely to be exposed to harmful ultraviolet radiation if UV light source 502 is activated.

In some embodiments, external devices 514 may comprise a light switch configured to control the room light. The light switch may be configured to wirelessly communicate with receiver 510 (e.g., using Wi-Fi or Bluetooth). In some embodiments, the light switch may transmit a signal to receiver 510 when it is closed (i.e., when the room light is turned off). In some embodiments, the light switch may transmit a signal to receiver 510 when it is opened (i.e., when the room light is turned on). Processors 512 may be configured to cause controller 504 to control UV light source 502 based on signal(s) received from the light switch. In some embodiments, if UV light source 502 is activated when receiver 510 receives a signal from the light switch indicating switch is open, processors 512 may be configured to cause controller 504 to deactivate UV light source 502.

In some embodiments, external devices 514 may comprise a photodetector configured to detect an amount of ambient light in the room where the sanitary ware is located. The photodetector may be configured to wirelessly communicate with receiver 510 (e.g., using Wi-Fi or Bluetooth). In some embodiments, the photodetector may transmit a signal to receiver 510 when the amount of ambient light in the room has dropped below a threshold level. In some embodiments, the photodetector may transmit a signal to receiver 510 when the amount of ambient light in the room increases at a high rate (e.g., when a light in the room is turned on). Processors 512 may be configured to cause controller 504 to control UV light source 502 based on signal(s) received from the photodetector. In some embodiments, if UV light source 502 is activated when receiver 510 receives a signal from the photodetector indicating that the amount of ambient light has increased, processors 512 may be configured to cause controller 504 to deactivate UV light source 502.

In some embodiments, external devices 514 may comprise an electronic door lock for a door to a room where the sanitary ware is located. The electronic door lock may be configured to wirelessly communicate with receiver 510 (e.g., using Wi-Fi or Bluetooth). In some embodiments, the electronic door lock may be configured to unlock the door when a user swipes an access badge or enters an access code. When the electronic door lock is unlocked, it may transmit a signal to receiver 510 indicating that a user is entering the room where the sanitary ware is located. Processors 512 may be configured to cause controller 504 to control UV light source 502 based on signal(s) received from the door lock. In some embodiments, if UV light source 502 is activated when receiver 510 receives a signal from the door lock indicating a user has unlocked the door, processors 512 may be configured to cause controller 504 to deactivate UV light source 502.

In some embodiments, external devices 514 may comprise a sensor configured to determine when an entrance to a room where the sanitary ware is located is open. In some embodiments, receiver 510 may be configured to receive a signal from the sensor when the entrance is open. Processors 512 may be configured to cause controller 504 to control UV light source 502 based on this signal. In some embodiments, if UV light source 502 is activated when receiver 510 receives a signal from the sensor indicating that the entrance is open, processors 512 may be configured to cause controller 504 to deactivate UV light source 502.

In some embodiments, external devices 514 may comprise motion sensor for a room where the sanitary ware is located. The motion sensor may be configured to wirelessly communicate with receiver 510 (e.g., using Wi-Fi or Bluetooth). In some embodiments, the motion sensor may transmit a signal to receiver 510 if user movement has not been detected for more than a threshold period of time. In some embodiments, the threshold period of time may be greater than or equal to 1, 10, 20, 40, 60, 120, or 180 minutes. Processors 512 may be configured to cause controller 504 to control UV light source 502 based on this signal.

In some embodiments, the one or more activation conditions may comprise schedule information. Controller 504 may comprise a memory 506 configured to store schedule information that indicates one or more days and/or times of day when UV light source 502 should be active. Processors 512 may be configured to use the schedule information stored in memory 506 to control UV light source 502. In some embodiments, the one or more days and/or times of day when UV light source 502 should be active may be days and/or times of day when humans are unlikely to be present in the room where the sanitary ware is located. For example, in some embodiments, the sanitary ware may be a flush valve assembly or a faucet assembly in a public bathroom. The building where the public bathroom is located may not be open on certain days of the week (e.g., on weekends) or at certain times of day (e.g., between 5 p.m. and 7 a.m.). Memory 506 may contain this schedule information and processors 512 may be configured to cause controller 504 to activate UV light source 502 based on the schedule information.

In some embodiments, the one or more activation conditions may comprise two or more of the aforementioned conditions. For example, in some embodiments, controller 504 may be configured to receive signals from a photodetector for a room where the sanitary ware is located and from a motion sensor for a room where the sanitary ware is located. Controller 504 may be configured to activate UV light source 502 upon receiving a signal from the photodetector indicating that the light in the room is turned off and a signal from the motion sensor indicating that no motion is detected in the room. In some embodiments, determining when to activate UV light source 502 based on two or more activation conditions may reduce the probability of human exposure to harmful UV radiation.

In some embodiments, after the appropriate activation conditions have been met, controller 504 may be configured to keep UV light source 502 activated for a predetermined period of time. Specifically, after UV light source 502 has been activated, processors 512 may be configured to determine when a threshold activation time period has passed. In some embodiments, the threshold activation period may be associated with a minimum amount of time that UV light source 502 must illuminate target disinfection volume 518 in order to deliver a specific dose of ultraviolet light to target disinfection volume 518. In some embodiments, the threshold activation period may be greater than or equal to 0.5, 1, 10, 30, 60, 120, 180, or 240 minutes. In some embodiments, the threshold activation period may be less than or equal to 0.5, 1, 10, 30, 60, 120, 180, or 240 minutes. In some embodiments, the threshold activation period may be between about 1-10, about 10-30, about 30-60, or about 60-120 minutes. After processors 512 determine that UV light source 502 has been activated for at least the threshold activation period, processors 512 may be configured to cause controller 504 to deactivate UV light source 502.

Figure 6:
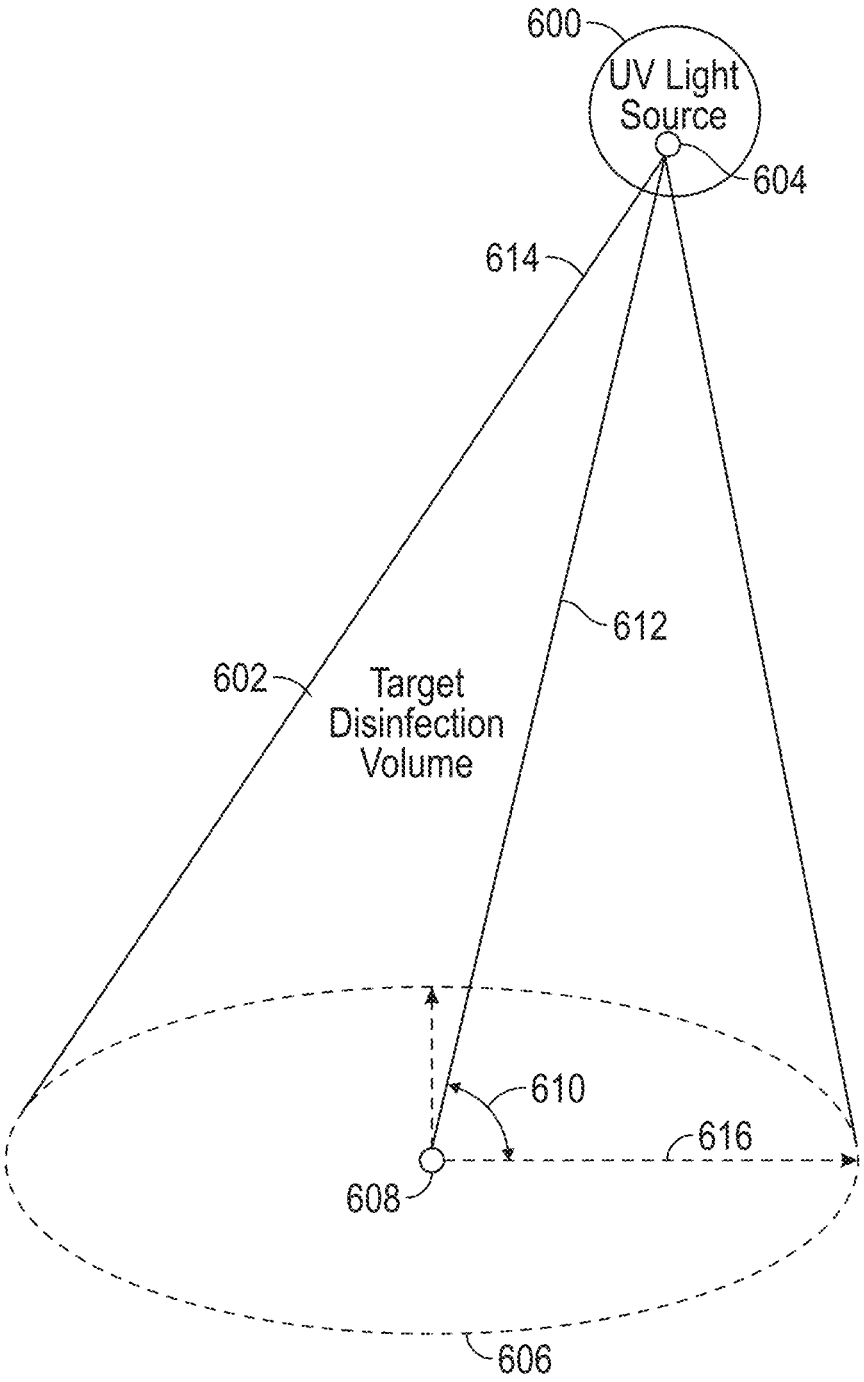
FIG. 6 illustrates an exemplary target disinfection volume, according to some embodiments.

FIG. 6 illustrates an exemplary target disinfection volume, according to some embodiments. Specifically, FIG. 6 shows a UV light source 600 illuminating a target disinfection volume 602. In some embodiments, target disinfection volume 118 shown in FIGS. 1A-1C, target disinfection volume 218 shown in FIGS. 2A-2C, and/or target disinfection volume 410 shown in FIGS. 4A-4B may include one or more features of target disinfection volume 602.

As shown, target disinfection volume 602 may be a conical volume. The apex 604 of the conical volume may be located at UV light source 600. The base 606 of the conical volume may have an approximately circular shape that is centered at a center point 608. The center line 612 of the conical volume may be a straight line from apex 604 to center point 608. The conical volume may have an apex angle 614. The spatial position of apex 604 relative to center point 608 may be defined by a center angle 610 between center line 612 and a line 616 parallel to base 606.

In some embodiments, the total volume contained by target disinfection volume 602 may depend on apex angle 614. As apex angle 614 increases, the radius of base 606 may also increase, thereby increasing the total spatial volume encompassed by target disinfection volume 602 for a given length of center line 612. In some embodiments, apex angle 614 may be greater than or equal 5, 10, 15, 20, 25, 30, 35, 40, 45, 50, 55, 60, 65, or 70 degrees. In some embodiments, apex angle 614 may be less than or equal 5, 10, 15, 20, 25, 30, 35, 40, 45, 50, 55, 60, 65, or 70 degrees. In some embodiments, apex angle 614 may be between about 10-20, 10-30, 10-40, 10-50, 10-60, 10-70, 10-80, or 10-90 degrees.

In some embodiments, UV light source 600 may be adjustable between cone-width configurations. In some embodiments, each cone-width configuration may be defined by a total volume contained by target disinfection volume 602, and UV light source 600 may be adjusted between the one or more cone-width configurations by changing apex angle 614.

As mentioned above, the spatial position of apex 604 relative to center point 608 may be defined by a center angle 610 between center line 612 and a line 616 parallel to base 606. In some embodiments, center angle 610 may be greater than or equal 5, 10, 15, 20, 25, 30, 35, 40, 45, 50, 55, 60, 65, or 70 degrees. In some embodiments, center angle 610 may be less than or equal 5, 10, 15, 20, 25, 30, 35, 40, 45, 50, 55, 60, 65, or 70 degrees. In some embodiments, center angle 610 may be between about 10-20, 10-30, 10-40, 10-50, 10-60, 10-70, 10-80, or 10-90 degrees.

In some embodiments, UV light source 600 may be adjustable between one or more directional configurations. In some embodiments, each directional configuration may be defined by a direction of center line 612 relative to UV light source 600, and UV light source 600 may be adjusted between the one or more directional configurations by changing center angle 610.

Figure 7:
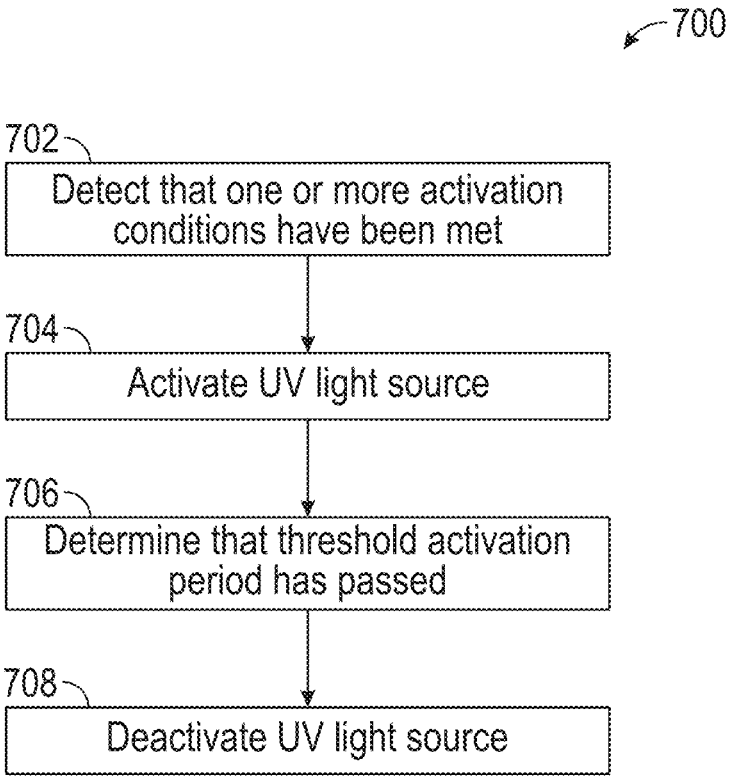
FIG. 7 illustrates an exemplary method for activating an ultraviolet sanitizing system, according to some embodiments.

FIG. 7 illustrates an exemplary method for activating an ultraviolet sanitizing system, according to some embodiments. Specifically, FIG. 7 shows a method 700 for activating a UV light source based on a determination that one or more activation conditions have been met. In some embodiments, method 700 may be executed by a controller (e.g., controller 504 of UV sanitizing system 500 shown in FIG. 5) of an ultraviolet sanitizing system (e.g., UV sanitizing system 500 shown in FIG. 5) that is a component of a sanitary ware (e.g., flush valve assembly 100 shown in FIGS. 1A-1C, flush valve assembly 200 shown in FIGS. 2A-2C, or faucet assembly 400 shown in FIGS. 4A-4C).

In some embodiments, method 700 may include a step 702, wherein one or more processors of the controller may detect that one or more activation conditions have been met. In some embodiments, one or more activation conditions may be associated with a user presence within a certain proximity of the sanitary ware. In some embodiments, determining that one or more activation conditions have been met may comprise receiving one or more signals from one or more devices external to the sanitary ware (e.g., presence sensors, motion sensors, light switches, photodetectors, electronic door locks, etc.). In some embodiments, one or more activation conditions may be associated with a current configuration of the sanitary ware (e.g., a spatial configuration of a faucet body relative to a sink, as described with respect to FIG. 4). In some embodiments, one or more activation conditions may be associated with a time of day or a day of the week. Additional discussion of exemplary activation conditions may be found in the description of FIG. 5.

In some embodiments, after determining that the one or more activation conditions have been met, method 700 may proceed to a step 704, wherein the one or more processors of the controller may cause the controller to activate the UV light source. In some embodiments, the controller may activate UV light source by controlling a current flow from a power supply to the UV light source, for example by closing a switch.

Once the UV light source has been activated in step 704, method 700 may proceed to a step 706, wherein the one or more processors may determine that a threshold activation period of time has passed. In some embodiments, the threshold activation period may be associated with a minimum amount of time that the UV light source must be activated in order to deliver a specific dose of ultraviolet light to a target.

In some embodiments, after determining that the threshold activation period has passed, the one or more processors of the controller may cause the controller to deactivate the UV light source. In some embodiments, the controller may deactivate UV light source by controlling a current flow from a power supply to the UV light source, for example by opening a switch.

UV Sanitizing Solutions for Bathroom Stalls

Figure 8:
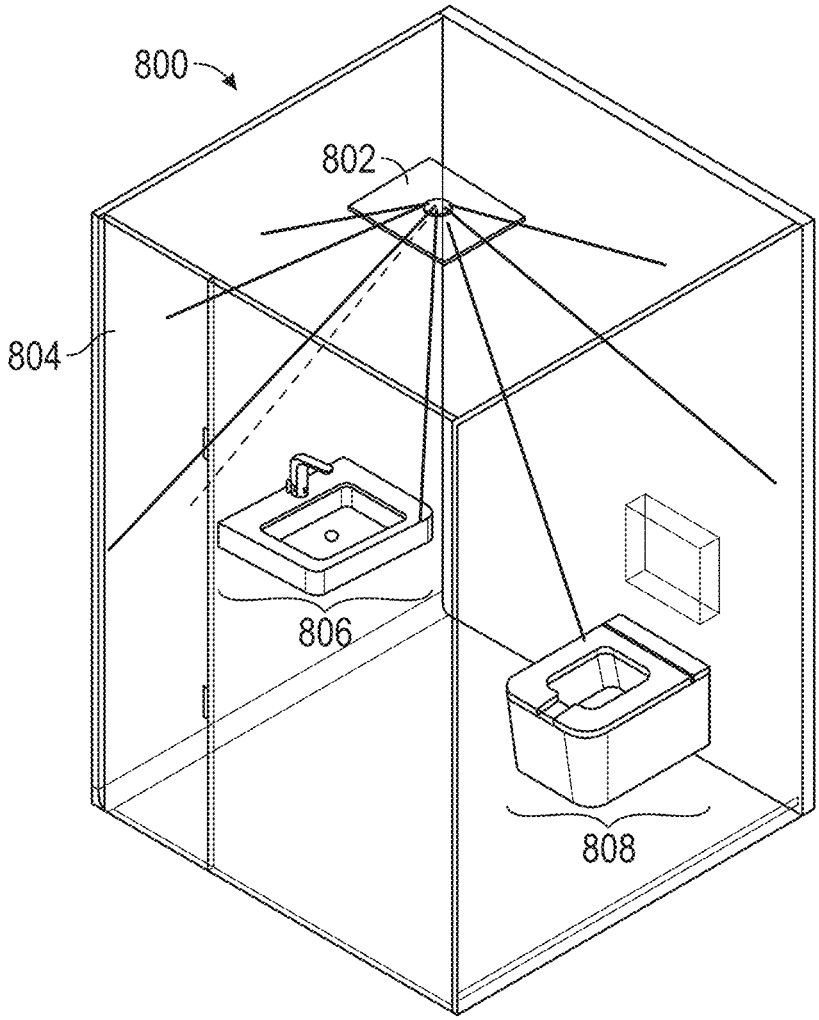
FIG. 8 illustrates a bathroom stall having an exemplary ultraviolet sanitizing system, according to some embodiments.

FIG. 8 illustrates a bathroom stall having an exemplary ultraviolet sanitizing system, according to some embodiments. Specifically, FIG. 8 illustrates a bathroom environment 800 comprising a UV sanitizing system 802 mounted on the ceiling. In some embodiments, bathroom environment 800 may be a bathroom stall (e.g., in a public restroom). In some embodiments, bathroom environment 800 may be a private or individual bathroom. In some embodiments, UV sanitizing system 802 may include one or more features of UV sanitizing system 500 shown in FIG. 5.

When activated, UV sanitizing system 802 may comprise a UV light source configured to illuminate a target disinfection volume 804. In some embodiments, target disinfection volume 804 may include one or more sanitary wares contained in bathroom stall 800. For example, in some embodiments, target disinfection volume 804 may include a sink and faucet assembly 806 and a sanitary ware 808 (e.g., a toilet or a urinal). In some embodiments, UV sanitizing system 802 may be configured to target airborne pathogens that may be present in bathroom stall 800.

In some embodiments, UV sanitizing system 802 may be configured to activate the UV light source when one or more activation conditions have been met. One or more of the activation conditions may be associated with a user presence in bathroom stall 800.

In some embodiments, bathroom environment 800 may comprise one or more sensors configured to measure or sense one or more conditions associated with user presence in bathroom environment 800. In some embodiments, the one or more sensors may comprise a presence sensor or a motion sensor configured to detect a human presence in bathroom environment 800. In some embodiments, the one or more sensors may comprise a photodetector configured to detect light in bathroom environment 800. In some embodiments, the one or more sensors may comprise a sensor configured to determine when an entrance to bathroom environment 800 is open. In some embodiments, the one or more activation conditions monitored by UV sanitizing system 802 may be based upon signals received from the one or more sensors.

CONCLUSION

Any one or more characteristics of any of the embodiments (including claims) described, shown, and/or referenced herein may be combined, in whole or in part, with any one or more characteristics of any one or more other embodiments (including claims) described, shown, and/or referenced herein.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A flush valve assembly comprising:

a flush valve housing mounted above a sanitary ware and spaced apart from a wall on the same side of the wall as the sanitary ware, wherein the flush valve housing houses a flush valve that is configured to be fluidically connected to and receive flush water from a water supply;

a flush water delivery pipe comprising an inlet end that is fluidically connected to and configured to receive the flush water from the flush valve and comprising an outlet and that is fluidically connected to and configured to deliver the flush water to a sanitary ware;

an ultraviolet (UV) light source housed at least partially within the flush valve housing and positioned on the same side of the wall as the sanitary ware, wherein the UV light source is configured to emit UV light through an aperture formed in the flush valve housing, wherein the emitted UV light illuminates a target disinfection volume and wherein the UV light source is adjustable between at least a first directional configuration and a second directional configuration, wherein, in the first directional configuration, a center-line of the target disinfection volume is directed in a first direction from the UV light source, and, in the second directional configuration, the center-line of the target disinfection volume is directed in a second direction from the UV light source that is different from the first direction; and a controller comprising one or more processors, wherein the controller is electrically coupled to the UV light source, and wherein the one or more processors are configured to cause the controller to: detect that one or more activation conditions have been met; and in response to detecting that the one or more activation conditions have been met, activate the UV light source.

2. The flush valve assembly of claim 1, wherein the sanitary ware is a toilet.

3. The flush valve assembly of claim 2, wherein the target disinfection volume includes a toilet bowl of the toilet, a toilet seat of the toilet, and a portion of a floor below the toilet.

4. The flush valve assembly of claim 1, wherein the sanitary ware is a urinal.

5. The flush valve assembly of claim 4, wherein the target disinfection volume includes a urinal bowl of the urinal, a top surface of a urinal housing of the urinal, and a portion of a floor below the urinal.

6. The flush valve assembly of claim 1, wherein the target disinfection volume comprises a conical volume with an apex at the UV light source.

7. The flush valve assembly of claim 6, wherein an apex angle of the conical volume is greater than or equal to 10 degrees and less than or equal to 60 degrees.

8. The flush valve assembly of claim 1, wherein the UV light source is adjustable between at least a first cone-width configuration and a second cone-width configuration, wherein, in the first cone-width configuration, the conical volume is defined by a first apex angle and, in the second cone-width configuration, the conical volume is defined by a second apex angle.

9. The flush valve assembly of claim 1, wherein the UV light emitted by the UV light source has a wavelength greater than or equal to 200 nanometers and less than or equal to 280 nanometers.

10. The flush valve assembly of claim 1, wherein the UV light source is configured to deliver a dose of the UV light greater than or equal to 5.0 $mJ/cm^2$ throughout the threshold disinfection volume.

11. The flush valve assembly of claim 1, wherein the UV light source comprises one or more LEDs.

12. The flush valve assembly of claim 1, comprising a presence sensor, wherein the one or more activation conditions comprise that a user is detected by the presence sensor within a predetermined proximity of the sanitary ware.

13. The flush valve assembly of claim 1, comprising a presence sensor, wherein detecting that the one or more activation conditions have been met comprises:

receiving a first user presence status from the presence sensor indicating that a user is within a predetermined proximity of the sanitary ware;

determining that the flush valve has been opened by the valve control;

determining that the flush valve has closed; and receiving a second user presence status from the presence sensor indicating that the user is no longer within the predetermined proximity.

14. The flush valve assembly of claim 1, wherein the one or more activation conditions comprise that a room light is off for a room in which the sanitary ware is located.

15. The flush valve assembly of claim 1, wherein the one or more activation conditions comprise that a person is not present within a room in which the sanitary ware is located.

16. The flush valve assembly of claim 1, wherein the one or more activation conditions comprise that one or more predetermined schedule criteria are met.

17. The flush valve assembly of claim 1, wherein, after activating the UV light source, the controller is configured to determine that a threshold activation period has passed and, in response to determining that the threshold activation period has passed, deactivate the UV light source.

18. The flush valve assembly of claim 17, wherein the threshold activation period is greater than or equal to 1 minute and less than or equal to 30 minutes.

19. The flush valve assembly of claim 1, wherein the controller is further configured to deactivate the UV light source upon detecting a user presence within the target disinfection volume.

* * * * *